US006758287B2

(12) United States Patent
Pröls et al.

(10) Patent No.: US 6,758,287 B2
(45) Date of Patent: Jul. 6, 2004

(54) SUPPORT FOR SUPPORTING A POWER TOOL ON A DISPLACEMENT CARRIAGE

(75) Inventors: Tim Pröls, Munich (DE); Konrad Artmann, Wörthsee (DE); Martin Richter, Freising (DE)

(73) Assignee: Hilti Aktiengesellschaft, Schaan (LI)

( * ) Notice: Subject to any disclaimer, the term of this patent is extended or adjusted under 35 U.S.C. 154(b) by 67 days.

(21) Appl. No.: 10/194,505

(22) Filed: Jul. 12, 2002

(65) Prior Publication Data

US 2003/0010535 A1 Jan. 16, 2003

(30) Foreign Application Priority Data

Jul. 14, 2001 (DE) ..... 101 34 292
Oct. 6, 2001 (DE) ..... 101 49 361

(51) Int. Cl.[7] ..... B25D 17/14
(52) U.S. Cl. ..... 173/197; 173/168; 173/171
(58) Field of Search ..... 251/209, 310; 173/168, 167, 199, 197, 74, 171

(56) References Cited

U.S. PATENT DOCUMENTS 762,861 A * 6/1904 Keller ..... 251/238
1,704,053 A * 3/1929 Miller ..... 285/111
1,739,141 A * 12/1929 Hansen ..... 173/199
2,199,337 A 4/1940 Gartin
2,230,881 A * 2/1941 Browne ..... 277/368
2,270,927 A * 1/1942 Browne ..... 285/94
3,280,842 A * 10/1966 Weisenbach ..... 137/625.17
3,381,761 A * 5/1968 Anders ..... 173/19
3,874,678 A * 4/1975 Potter ..... 277/366
3,896,194 A * 7/1975 Martin ..... 261/41.5
3,931,853 A * 1/1976 de Putter ..... 165/87
4,293,251 A * 10/1981 Anderson ..... 408/59
4,520,879 A * 6/1985 MacElvain ..... 173/199
6,062,322 A 5/2000 Beccu et al.
6,237,568 B1 * 5/2001 Askew et al. ..... 123/446

* cited by examiner

*Primary Examiner*—John Sipos
*Assistant Examiner*—Louis Tran
(74) *Attorney, Agent, or Firm*—Sidley Austin Brown & Wood, LLP

(57) ABSTRACT

A support for supporting a power tool (3) on a displacement carriage (2) and including an attachment element (7) for connecting the power tool (3) with the carriage (2), and a bolt insertable into an eyelet (8) of the power tool (9) for releasably connecting the attachment element (7) with the power tool (3) with the bolt (6) having axial and radial conduits (12, 13) communicating with an outer cylindrical surface of the bolt (6), so that predetermined position of the bolt (6) in the eyelet (8), a drilling fluid can be delivered through the bolt (6) to fluid conduits (4) of the power tool (1).

8 Claims, 3 Drawing Sheets

SUPPORT FOR SUPPORTING A POWER TOOL ON A DISPLACEMENT CARRIAGE

BACKGROUND OF THE INVENTION

1. Field of the Invention

The present invention relates to a support for supporting a power tool, in particular, a percussion power tool such as, e.g., a hammer drill for forming blast bores in mining industry, on a displacement carriage.

2. Description of the Prior Art

Conventionally, heavy hammer drills, which weigh more than 10 kg such as used in the mining industry, a releasably mounted on displacement carriages having a spindle drive for self-propelled displacement for forming bores. The power tools, which are pneumatically or electrically driven, are high-powered tools and are usually air- or water-cooled.

European Publication EP 107629 discloses a hammer drill with a pneumatic percussion mechanism and having a brushless, air-cooled electric motor electronically commutated via an inverted rectifier.

U.S. Pat. No. 3,880,244 discloses a percussion power tool that is releasably mounted on a displacement carriage displaceable by a hydraulic motor via a threaded rod. However, there is no delivery of cooling medium from the carriage to the power tool.

German Publication DE 36 12 762 discloses a percussion power tool driven by a hydraulic motor and supported on a displacement carriage by support means. The displacement carriage is displaced by a threaded rod driven by another hydraulic motor. No delivery of fluid through the support arm to the power tool takes place.

International publication WO 96/06714 discloses a water-cooled electrical core drill supported on a displacement carriage by a support. The tool support is formed as a fork-shaped mount connected with the carriage by a bolt extending through an eyelet provided on the carriage. The bolt is provided with partially axial and radial lubrication bores which open at the cylindrical outer surface of the bolt for lubricating the support. There is no flow of the drilling or cooling medium or fluid to the power tool itself.

Accordingly, an object of the present invention is to provide a support for supporting a power tool on a displacement carriage and including means for delivering a drilling or cooling fluid to the power tool.

SUMMARY OF THE INVENTION

This and other objects of the present invention, which will become apparent hereinafter, are achieved by providing a support for supporting a power tool on a displacement carriage and including attachment means for connecting the power tool with the carriage, and a bolt insertable into an eyelet provided on the tool housing for releasably connecting the attachment means with the power tool, the bolt having axial conduit means and a radial conduit means for communicating the axial conduit means with an outer cylindrical surface of the bolt. Thereby in a predetermined position of the bolt in the eyelet, a drilling fluid can be delivered through the bolt to the fluid conduit means of the power tool.

According to the present invention, there is provided fluid conduit means for delivering a drilling or cooling fluid from the displacement carriage to the power tool and further to the working tool via conduit means provided in the attachment member and the connecting bolt. The present invention eliminates separate connection and disconnection of the fluid conduit means of the power tool with the cooling fluid delivering conduit means during mounting of the power tool on the carriage and dismounting it therefrom.

Advantageously, there is provided closing means that prevents the bolt from being lost upon a complete withdrawal of the bolt. This is particularly important for insuring the service readiness of the power tool.

Alternatively, the bolt can be formed as a pin having a section projecting beyond the attachment member and fixedly connected with the attachment member, which is formed as a fork head half. The pin-shaped bolt has a through bore for receiving a security splint. This permits a single operator to connect a heavy power tool to the carriage in a first step and secure the power tool thereto in a second step.

Advantageously, the bolt is associated with a locking pin that is formlockingly received in an eyelet formed in the power tool housing and extending parallel to the eyelet the bolt is received in. This permits to properly secure the power tool on the support.

Advantageously, the bolt and the locking pin form legs of a U-shaped insertion member, which permits to insert both the bolt and the locking pin in the attachment member and the respective eyelets of the housing in a single operational step.

Alternatively, the bolt can be formlockingly pivotally received in the housing eyelet which permits, by changing the angular position of the bolt, to block flow of the cooling fluid to the power tool. This eliminates a need in additional fluid flow blocking means. In this case, the bolt forms a middle part of a U-shaped lever with a first leg of the U-shaped lever forms a locking lever for pivoting the bolt and a second leg forms a stop for preventing a complete withdrawal of the bolt.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
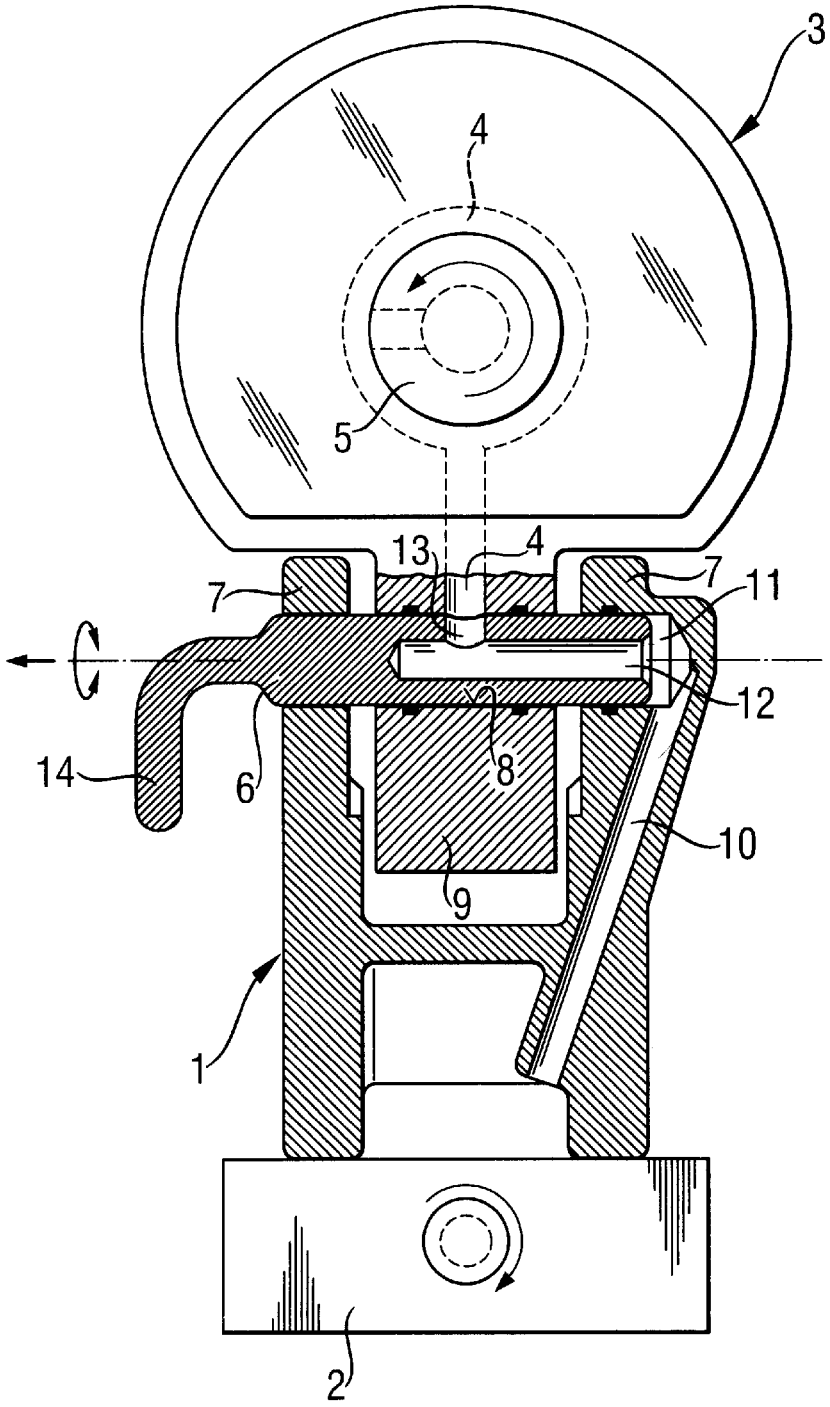
FIG. 1 shows a cross-sectional view of a first embodiment of a support according to the present invention for supporting a power tool on a displacement carriage.

A power tool support 1 according to the present invention, a first embodiment of which is shown in FIG. 1, is designed for supporting a power tool 3 on a displaceable carriage 2 provided with a threaded spindle displaceable perpendicular to the plane of the drawing. The power tool 3 likewise operates perpendicular to the plane of the drawing. The power tool, which is a percussion power tool has a working tool 5 and fluid conduit means 4 for delivery of a drilling fluid to the working tool 5. The power tool support 1 further includes an axially displaceable bolt 6 having an outer, cylindrical function surface and extending through an attachment member 7, which is formed as a fork-head, and an eyelet 8 provided on a housing 9 of the power tool 1. The fork head has, in one of its cheek, a flush bore 10 that opens into a blind bore 11. The bolt 6 has its free end sealingly received in the blind bore 11. The bolt 6 has a central bore 12 that is closed at its end opposite the bore 11, and a radial bore 13 that communicates with the central bore 12. Dependent on an angular position of the bolt 6 which is sealingly pivotally supported in the eyelet 8 and the angular position of which is adjusted by a lever 14, a fluid communication can be established between the fluid conduit means 4, which ends at the inner surface of the eyelet 8, and the central bore 12 of the bolt 6 via the radial bore 13.

Figure 2:
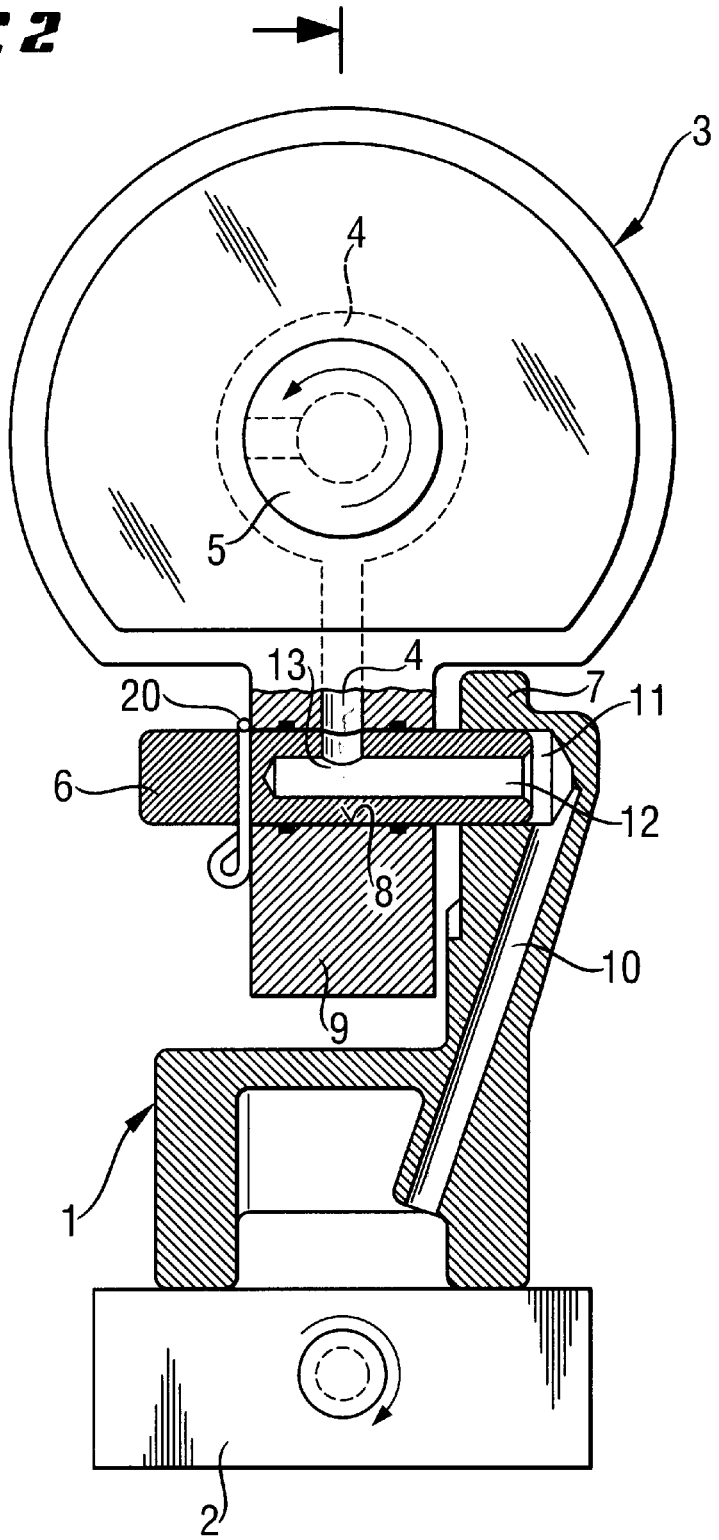
FIG. 2 shows a cross-sectional view of a second embodiment of a support according to the present invention for supporting a power tool on a displacement carriage.

A power tool support 1, a second embodiment of which is shown in FIG. 2, likewise includes an axially displaceable bolt 6 having an outer cylindrical function surface and extending through the attachment member, 7 which is formed as a fork head half, and the eyelet 8 provided on the housing 9 of the power tool 3. The bolt 6 is formed as a pin having a portion thereof projecting from the housing 9 of the power tool 3. The bolt 6 is secured with locking means 20 formed as a splint extending radially through the bolt 6. The fork head half has, in its cheek, a flush bore 10 that opens into a blind bore 11 and end surface of which forms a stop for the bolt 6. The bolt 6 has its free end sealingly received in the blind bore 11. The bolt 6 has a central bore 12 that is closed at its end opposite the bore 11, and a radial bore 13 that communicates with the central bore 12.

Figure 3:
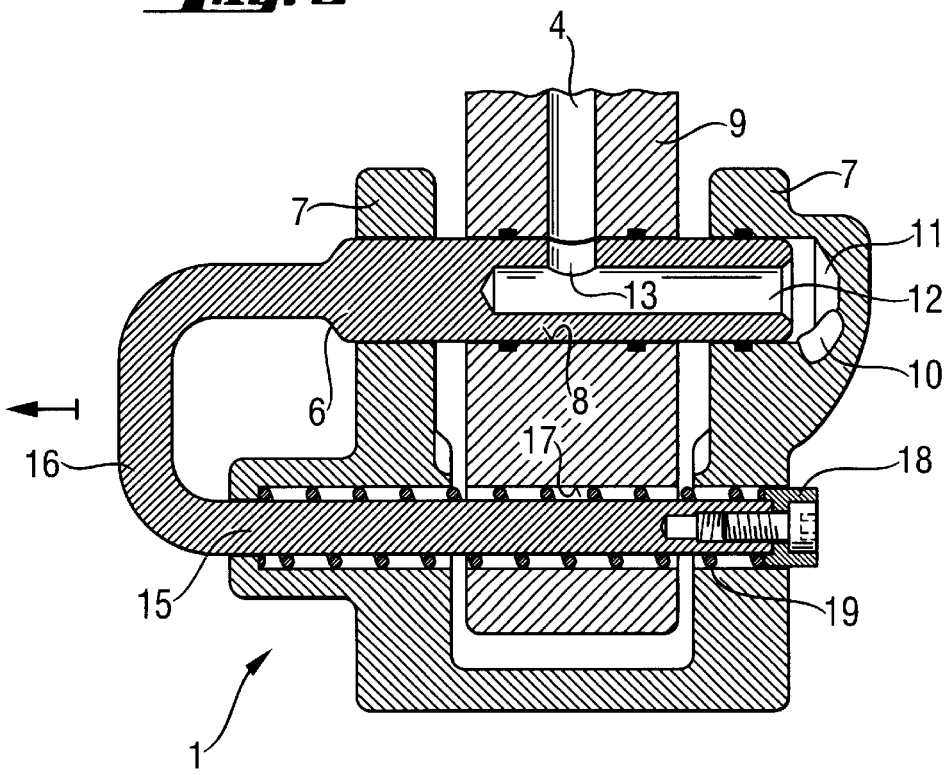
FIG. 3 shows a cross-sectional view of a third embodiment of a support according to the present invention for supporting a power tool on a displacement carriage.

In the third embodiment of the power tool support 1, which is shown in FIG. 3, the bolt 5 and a locking pin 15 form legs of a U-shaped insertion member 16 capable of a limited axial displacement. The locking pin 15, which extends through the attachment member 7, which is formed as a fork head, and a bore 17 extending parallel to the eyelet 8, has, at its end, closing means 18 in form of a radially projecting screw that secures the locking pin 15 in the bore 17. A helical spring 19, which is formed as a compression spring, extends between a cheek of the fork head and the closing means 18.

Though the present invention was shown and described with references to the preferred embodiment, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A support for supporting a power tool (3) on a displacement carriage (2), comprising attachment means (7) for connecting the power tool (3) with the carriage (2); and a bolt insertable into an eyelet (8) of a power tool housing (9) for releasably connecting the attachment means (7) with the power tool (3), the bolt (6) having axial conduit means (12) and radial conduit means (13) communicating the axial conduit means (12) with an outer cylindrical surface of the bolt (6), whereby in a predetermined position of the bolt (6) in the eyelet (8), a drilling fluid can be delivered through the bolt (6) to fluid conduit means (4) of the power tool (1).

2. A support according to claim 1, wherein the bolt (6) is supported for a limited axial displacement, and wherein the attachment means (7) has a stop for the bolt (6).

3. A support according to claim 2, wherein the stop is formed as closing means (18) that also prevents the bolt (6) from being lost upon a complete withdrawal of the bolt (6).

4. A support according to claim 1, comprising a locking pin (15) associated with the bolt (6) and formlockingly received in a eyelet (17) formed in the tool housing (9) and extending parallel to the eyelet (8) the bolt (6) is received in.

5. A support according to claim 4, wherein the bolt (6) and the locking pin (15) form legs of a U-shaped insertion member (16).

6. A support according to claim 1, wherein the conduit means (4) of the power tool (1) becomes blocked in a predetermined angular position of the bolt (6).

7. A support according to claim 6, wherein the bolt (6) forms a middle portion of a U-shaped lever (14), with a first leg of the U-shaped lever (14) forming a locking lever for pivoting the bolt (6) and a second leg forming stop means for preventing a complete withdrawal of the bolt (6).

8. A support according to claim 1, wherein the bolt (6) is formed as a pin having a portion thereof projecting beyond the attachment member (7), and wherein the carrier has means (20) for fixedly connecting the bolt (6) to the attachment member (7).

* * * * *